US005476125A

United States Patent [19]

Mitchell

[11] Patent Number: 5,476,125

[45] Date of Patent: Dec. 19, 1995

[54] VAPOR RECOVERY GASOLINE DISPENSING NOZZLE

[75] Inventor: Thomas O. Mitchell, St. Louis County, Mo.

[73] Assignee: Husky Corporation, Pacific, Mo.

[21] Appl. No.: 264,966

[22] Filed: Jun. 24, 1994

[51] Int. Cl.[6] ..... B65B 31/00

[52] U.S. Cl. ..... 141/59; 141/206; 141/DIG. 1; 141/308; 141/392

[58] Field of Search ..... 141/206–229, 141/392, DIG. 1, 302, 307, 308, 98, 198, 59

[56] References Cited

U.S. PATENT DOCUMENTS 4,133,355 1/1979 Mayer ..... 141/302
4,142,562 3/1979 Murray ..... 141/206
4,429,725 2/1984 Walker et al. ..... 141/59
5,273,087 12/1993 Koch et al. ..... 141/392
5,327,944 7/1994 Healy ..... 141/206

*Primary Examiner*—Henry J. Recla
*Assistant Examiner*—Steven O. Douglas
*Attorney, Agent, or Firm*—Paul M. Denk

[57] ABSTRACT

A fuel nozzle assembly for dispensing fuel from a source to a container includes a body defining a fuel flow path and a vapor recovery path. The nozzle includes a venturi valve in the fuel flow path which defines a venturi port and a diaphragm valve positioned in the vapor recover path, The diaphragm valve has a control section having a control port which is in fluid communication with the venturi. The diaphragm valve is normally spring biased closed. When gas flows through the venturi and over the venturi port, it creates a vacuum in the diaphragm control section sufficiently strong to open the diaphragm valve so that recovered vapors may be returned to a source of fuel, or other collection area, such as an underground storage fuel tank.

3 Claims, 2 Drawing Sheets

VAPOR RECOVERY GASOLINE DISPENSING NOZZLE

BACKGROUND OF THE INVENTION

This invention relates to nozzles used for dispensing gasoline for automobiles and the like, and more particularly, to nozzles which incorporate vapor recovery systems.

Gasoline dispensing nozzles of the type found in most service stations use a spout which is inserted into the inlet of an automobile's fuel tank. Because of environmental concerns, many states require that fuel dispensing nozzles be designed to capture fuel vapors, which would otherwise escape to the atmosphere, and return them to the fuel source.

To return fuel vapors to the source, nozzle assemblies include a vapor return line which draws the vapors from the end of the nozzle and returns them to the fuel source. The usual type vapor recovery means includes the vacuum assist or the balanced pressure type systems. To prevent the escape of fuel vapors from the fuel source, the vapor return line must be closed when fuel is not being pumped from the source to an automobile. There are a variety of methods to close the vapor recovery line. However, there is still a need for a simple, reliable, and cost effective method of closing the vapor recovery line.

Summary of the Invention

One object of the present invention is to provide a fuel dispensing nozzle which will recover fuel vapors and return them to a fuel source.

Another object is to provide such a nozzle which does not affect the other functions of the nozzle.

Another object is to provide a check valve in the vapor retainer line and which is responsive to suction generated at the venturi.

Another object is to provide such a nozzle in which the vapor recovery is simple and reliable.

These and other objects will become apparent to those skilled in the art in light of the following disclosure and accompanying drawings.

In accordance with the invention, generally stated, a nozzle assembly for dispensing fuel from a source to a container includes a nozzle body defining a fuel flow path and a vapor recovery path. A spout is connected to the body and further defines a fuel flow path and a vapor recovery path, which are in fluid communication with the nozzle body fuel flow path and the body vapor recovery path, respectively. The nozzle may use the vacuum assist or the balanced pressure form of vapor recovery. A venturi valve is positioned in the body fuel flow path and includes a valve body, a valve seat, and a venturi valve member. The venturi valve member is movable between a first position in which it seats against the valve seat to close the valve, as when fuel is not being dispensed, and a second position in which the venturi valve is opened, as during fuel flow. The valve member is biased to normally close the venturi valve and hence the fuel flow path. The valve is opened by pressure from fuel flowing through the fuel flow path, as when the fuel dispensing is actuated. The valve closes when fuel flow through said fuel flow path ceases.

A diaphragm valve is positioned proximate the nozzle body vapor recovery flow path. The diaphragm valve is movable between a first position in which the vapor recovery flow path is closed and a second position in which the vapor recovery flow path is opened. The diaphragm valve is normally biased to the first, closed position, thereby preventing the untimely escape of vapors previously recovered.

The nozzle body includes a venturi defined by a port positioned so that fuel will flow past the port. The diaphragm valve includes a control section having a control port. A tube or path of communication, as built within the nozzle body, extends between the venturi port and the vapor control port. The flow of fuel over the venturi port creates a vacuum sufficiently strong to overcome the force of the spring which normally biases the diaphragm closed to open the diaphragm valve. Normally the venturi port is positioned downstream of the valve seat, in the venturi valve body.

The nozzle also includes an automatic shutoff to stop the flow of fuel through the nozzle when the container, such as the vehicle fuel tank, being filled with gas is determined to be full. The diaphragm valve automatically closes when the automatic shutoff means stops the flow of gas through the nozzle, or when the fuel flow is normally shut off.

BRIEF DESCRIPTION OF THE DRAWINGS

Corresponding reference characters indicate similar parts throughout the drawings.

DESCRIPTION OF THE PREFERRED EMBODIMENT

Figures 1, 2:
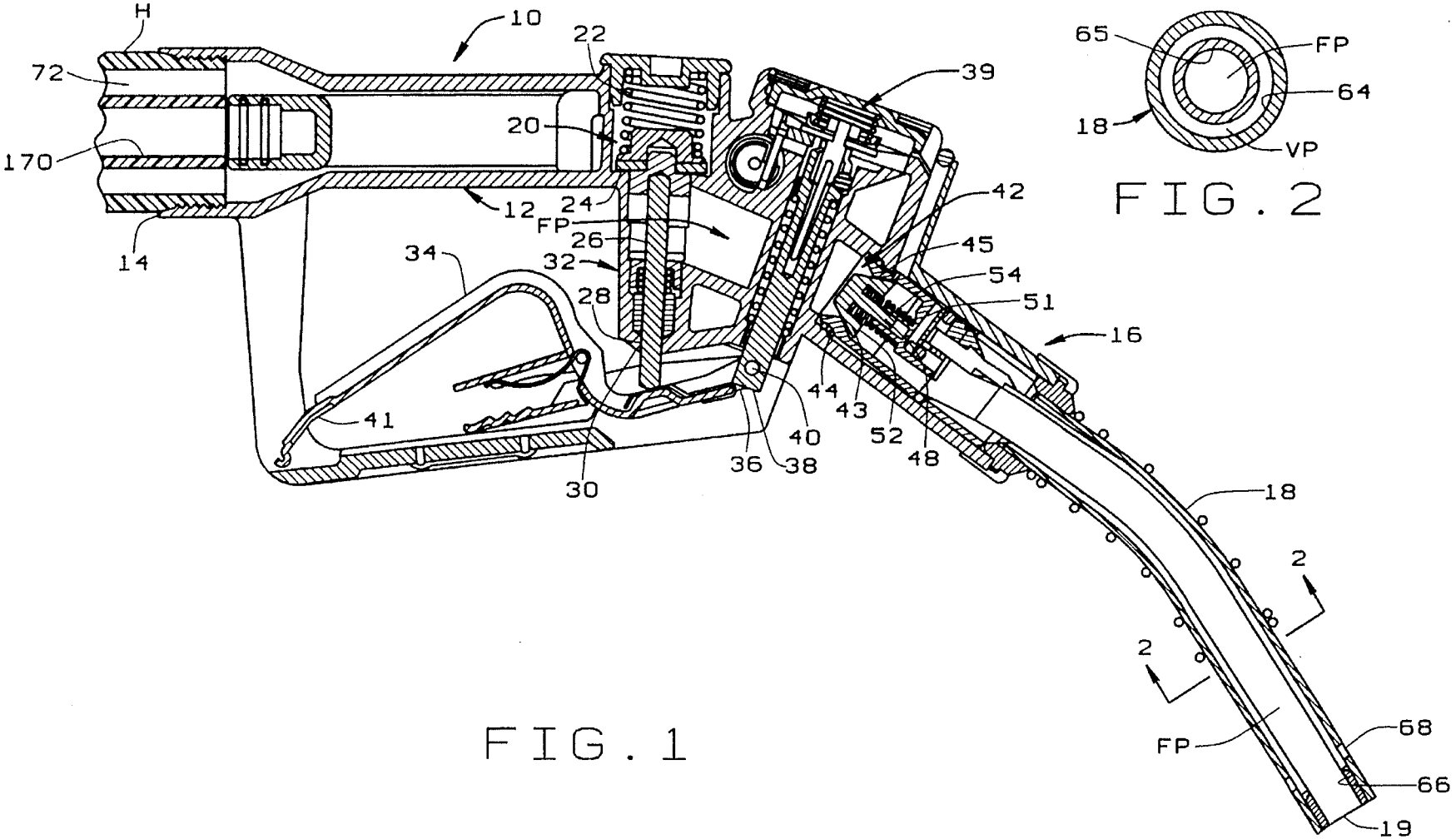
FIG. 1 is a cross-sectional view of a fuel dispensing nozzle.
FIG. 2 is a cross-sectional view of the nozzle taken along line 2—2 of FIG. 1, showing the fuel and vapor recovery paths.

Referring now to the FIG. 1, reference numeral 10 indicates one illustrative embodiment of a fuel dispensing nozzle of the present invention. Nozzle 10 includes a body 12 having an inlet 14 and an outlet 16 defining a fuel flow path FP. A fuel hose H extends between inlet 14 and a source (not shown) of fuel, such as a gas station's dispenser and underground storage tank, to pump the fuel from the source to an automobile's fuel tank, or some other container. A spout assembly 18 is connected to outlet 16 to be in fluid communication with flow path FP. Assembly 18 has a tip 19 which may be inserted into the automobile's tank, or other container, as is known.

A popper valve 20 is disposed within body 12, between the inlet 14 and outlet 16. Popper 20 is biased by a spring 22 into sealing engagement with a valve seat 24. Poppet 20 is secured to the upper end of a valve stem 26. The poppet is located in the upper portion of body 12 and the valve stem extends downwardly through the body. The lower end of the stem projects through an opening 28 in the base 30 of a body section 32. An operating lever 34 has a pivoting functional end 36 connected to the lower end of a plunger 38 by a pin 40. The other, free, end 41 of the lever is grasped by a user to operate the nozzle. When handle 34 is squeezed, the upward pressure of the lever forces valve stem 26 to move upwardly. The movement of stem 26 moves poppet 20 off valve seat 24 to open the said poppet, permitting the flow of fuel from the source through the nozzle. Plunger 38 is part of an automatic shut off system 39, such as described in U.S. Pat. No. 5,197,523 to Fink, Jr. et al. and which is incorporated herein by reference. The automatic shut off system will automatically close valve 22, when the tank is filled, or when other conditions are met, to stop the flow of gas through the nozzle.

A venturi valve 42 is positioned in fuel flow path FP in outlet 16. Venturi valve 42 includes a valve member 43 slidably received in a valve body 44 which defines a valve seat 45. Venturi valve 43 is biased against seat 45 by a spring 48. Spring 48 is placed around a stem 54 and extends between a support 51 of valve body 44 and a bottom face 52 of member 43. The pressure of fuel flowing through fuel flow path FP forces venturi valve 44 off seat 45 to open said valve 42. When valve 42 is opened, fuel flows through body outlet 16 into nozzle assembly 18, and out of its spout for fill-up purposes. As can also be seen provided through the valve seat 45, there are a series of ports, as at 46, that lead towards venting means to provide for extraction of fuel from a vapor recovery hose, such as shown in the U.S. Pat. No. 5,197,523, while the other staggered ports, such as one shown at 47, are for use in conjunction with the automatic shut-off feature of the nozzle, which is standard in the art, wherein the diaphragm means of an automatic shut-off means is responsive to the generation of the vacuum, generated at the venturi, and extracted through the port 47, for providing for immediate shut-off of the nozzle, when the fuel tank reaches a full capacity. This latter feature is well known in the art.

Nozzle assembly 18 includes an outer tube 64 (FIG. 2) and a concentric inner tube 65. Together, tubes 64 and 65 define an inner flow path which is an extension of fuel flow path FP, and an outer flow path VP through which fuel vapors flow to return to the fuel source. Vapor flow path VP normally does not extend to the end of spout 18. Rather, the spout includes a closure 66 at the end thereof. A port 68 above the tip 66 allows passage of fuel vapors into the vapor flow path VP. This normally is the structure for the vacuum assist style of nozzle.

Figure 3:
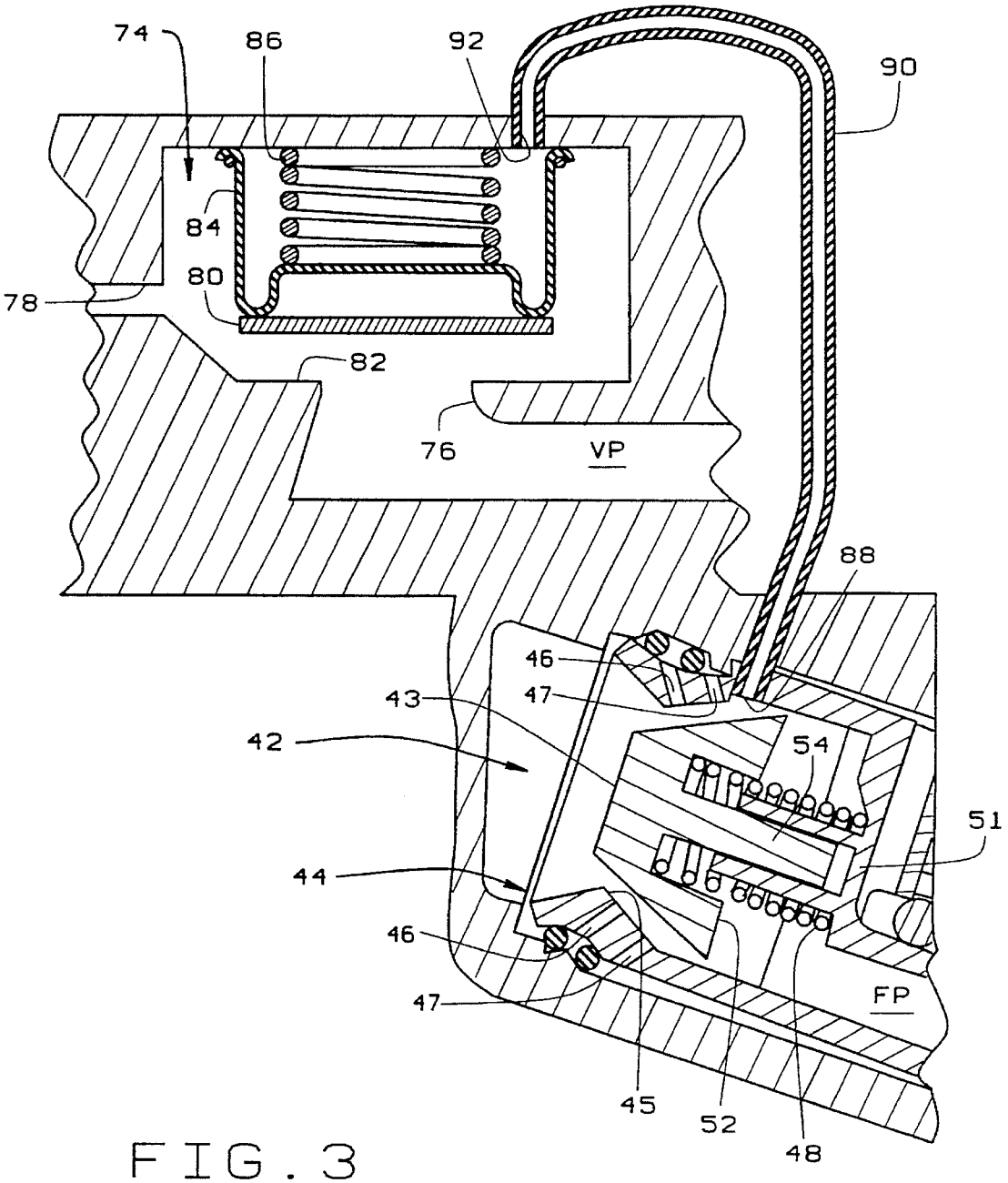
FIG. 3 is an enlarged cross-sectional, schematic drawing of the vapor recovery path shut off mechanism of the nozzle.

Turning to FIG. 3, the vapor flow path VP continues back into the nozzle body 12. As seen in FIG. 1, Hose H includes inner 70 and outer 72 concentric hoses. Inner hose 70 conventionally delivers fuel to the nozzle body 14 and is in fluid communication with fluid flow path FP to deliver fuel to the nozzle. Outer annular hose 72, on the other hand, is in fluid communication with the vapor flow path VP so that vapor and excess gas may be returned to the fuel storage tank. Obviously, the usage of these inner and outer hoses could be reversed.

To prevent fuel vapors from escaping from the storage tank when the gas is not flowing through the nozzle, a valve 74 is placed in the vapor flow path to close the flow path VP. This could locate in the nozzle body or at the vicinity of its extension 16. Valve 74 has an inlet 76, an outlet 78, and a valve element 80 which seats against a valve seat 82 to close the valve. The valve element includes a diaphragm 84 which is biased closed by a spring 86.

Valve 74 is operated by a vacuum formed at venturi valve 43. Venturi body 44 includes a port 88 across which fuel flows. A tube 90, or other path of communication, extends between port 88 and a control port 92 of valve 74. When fuel flows through venturi valve 42, gas flows over port 88, creating a venturi effect in tube 90. The suction created by the venturi effect pulls diaphragm 84 off seat 82 to open vapor valve 74, as shown in FIG. 3. While the valve 74 is opened, the vapor flow path between the nozzle and the storage tank is open and fuel vapors may be returned to the storage tank. When the fuel tank is full, the automatic shut off system 39 employed by the nozzle assembly stops the flow of fuel through the nozzle assembly. The flow of gas over port 88 stops, and the venturi effect ceases. The suction in tube 90 therefore ceases and the spring 86 forces the valve closed. With the valve closed, fuel vapors cannot escape out the nozzle through the vapor flow path VP. Obviously, the tube 90 can be built into or located on the side of the nozzle body as described to streamline the appearance of the nozzle.

As can be appreciated, the structure of the present invention provides a simple yet reliable system for closing the vapor flow line VP when the gas nozzle is not in use.

Variations within the scope of the appended claims may be apparent to those skilled in the art. The foregoing disclosure is therefore intended to be illustrative and is not meant to be limiting.

I claim:

1. In a nozzle assembly for dispensing fuel from a source to a container, the nozzle assembly comprising:

a nozzle body defining a fuel flow path and a vapor recovery path;

a spout connected to said body and defining a fuel flow path and a vapor recovery path, said spout fuel flow path being in fluid communication with said nozzle body fuel flow path and said spout vapor recovery path being in fluid communication with said nozzle body vapor recovery path;

a venturi valve positioned in said body fuel flow path, said venturi valve having a valve body, valve seat, and a valve member, said valve member being moveable between a first position in which it seats against said valve seat to close said venturi valve and a second position in which venturi valve is opened, said valve member being biased to normally close said venturi valve, said venturi valve being opened by pressure from fuel flowing through said fuel flow path, said venturi valve being closed when fuel flow through said fuel flow path stops;

a diaphragm valve positioned in said nozzle body vapor recovery flow path, said diaphragm valve being movable between a first position in which said vapor recovery flow path is closed and a second position in which said vapor recovery flow path is opened, said diaphragm valve being normally biased to said first, closed position, and said diaphragm valve including a control section having a control port;

said venturi having a port in said nozzle body in communication with said fuel flow path, operable when subject to venturi action to move said diaphragm valve between said closed and opened positions;

said venturi being defined by a path of communication extending between said diaphragm valve control port and said vapor port in said fuel flow path, said venturi creating a vacuum in said venturi port sufficiently strong to move said diaphragm valve from said first position to said second and opened position to allow the recovery of vapors, said venturi port is positioned downstream of said valve seat, said venturi is positioned in said valve body, and said diaphragm valve includes a spring in said control section to normally bias said diaphragm valve closed to prevent the escape of recovered vapors after fuel dispensing ceases.

2. The nozzle of claim 1 including an automatic shutoff means for stopping the flow of fuel through said nozzle when a tank being filled with gas is determined to be full; said diaphragm valve automatically closing when said automatic shutoff means stops the flow of fuel through said nozzle.

3. The nozzle of claim 2 and there being a spacing provided within said nozzle body vapor recovery flow path, said spacing being of a size to accommodate the formation of the control section, and to accommodate the locating of the diaphragm valve therein, said diaphragm valve being a rolling diaphragm, and said rolling diagphragm having located therein the said spring and the diaphragm valve control port for creating a vacuum within the diaphragm valve to attain its actuation between its opening and closing of the vapor recovery flow path during functioning of said nozzle assembly.

* * * * *